United States Patent [19]

Gravisse et al.

[11] 4,211,813

[45] Jul. 8, 1980

[54] PHOTOLUMINESCENT TEXTILE MATERIALS

[75] Inventors: Philippe E. Gravisse, Paris, France; Jacques F. Van Schoote, Ghent, Belgium

[73] Assignees: B.R.I.C. (Burea de Recherche pour l'Innovation et la Convervence, France; N.V. Anciens Etablissements Alsberge et Van Oost, Belgium

[21] Appl. No.: 888,037

[22] Filed: Mar. 20, 1978

[30] Foreign Application Priority Data

Mar. 25, 1977 [FR] France ..... 77 09042

[51] Int. Cl.[2] ..... C09K 11/00; C09K 11/10

[52] U.S. Cl. ..... 428/263; 2/1; 252/301.28; 252/301.33; 252/301.35; 252/301.36; 252/301.45; 252/301.65; 156/67; 427/157; 428/275; 428/309; 428/335; 428/339; 428/447; 428/500; 428/510; 428/539; 428/913; 428/425.9

[58] Field of Search ..... 428/283, 913, 263, 275, 428/309, 335, 339, 423, 424, 447, 500, 510, 539; 2/1; 427/157; 156/67; 260/42.24; 252/301.28, 301.33, 301.35, 301.36, 301.45, 301.65

[56] References Cited

U.S. PATENT DOCUMENTS

| | | | |
|---|---|---|---|
| 2,342,005 | 2/1944 | Mittag | 2/1 |
| 2,635,969 | 4/1953 | Goldstein | 427/157 |
| 2,650,169 | 8/1953 | Goldstein | 252/301.36 |
| 2,787,558 | 4/1957 | Wadely | 252/301.36 |
| 3,291,668 | 12/1966 | Goldstein | 428/913 |
| 3,499,416 | 3/1970 | Thorsheim | 2/1 |
| 3,738,299 | 6/1973 | Packler et al. | 428/913 |
| 3,830,682 | 8/1974 | Rowland | 428/913 |
| 4,127,499 | 11/1978 | Chen et al. | 427/157 |

OTHER PUBLICATIONS

The Condensed Chemical Dictionary, Van Nostrand Reinhold Co., ©1974, p. 324.

*Primary Examiner*—John D. Smith
*Attorney, Agent, or Firm*—Staas & Halsey

[57] ABSTRACT

Sheet materials are provided which are photoluminescent by virtue of their coating.

These sheet materials comprise a textile or other flexible sheet material substrate to which adheres a coating layer consisting of one or more synthetic resins admixed with a photoluminescent complex, the latter comprising (a) a phosphorescent metal sulphide such as zinc, calcium, cadmium or strontium sulphide and (b) a first substance which absorbs energy of short wavelength and emits it within the absorption spectrum of the said sulphide and with or without (c) a second substance which is fluorescent and which imparts to the said sheet materials a daytime coloration different from their nighttime coloration.

The sheet materials may be textile sheet materials useful for the production of garments, in particular safety garments and furnishing fabrics. Self-adhesive materials may also be produced.

16 Claims, No Drawings

PHOTOLUMINESCENT TEXTILE MATERIALS

FIELD OF THE INVENTION

This invention relates to textile and other flexible sheet materials which have been rendered photoluminescent by coating with a film of a mixture which comprises a synthetic resin together with various additives and in particular a photoluminescent complex.

SUMMARY OF THE INVENTION

The amounts of the additives and the resin are chosen to give the optimum photoluminescent effect without detracting from the normal state and characteristics of the textile or other flexible substrate which is coated. The object of the invention is to provide safety and protective garments which have the additional advantage of being readily visible and locatable at night. Because of the photoluminescent complex, they have the property, in the presence of a source of energy, of absorbing energy and emitting it again in the form of visible light and doing so for a relatively long period after the source of energy has disappeared. This energy source is chiefly visible light but it may also be heat, alpha, beta or gamma rays, and the like. The textile substrate is chiefly cotton but may equally well be a polyester, a cotton-polyester mixture, a polyamide or another synthetic fibre. Any other fibre which is not mentioned may be used. When the material is a textile substrate it may be in woven, knitted or non-woven form. A sheet of a flexible synthetic material or paper may replace a textile substrate in certain embodiments of the present invention.

It is advantageous for provision to be made for safety and protective garments formed from such textile materials not only to have the property of photoluminescence, and thus to be detectable at night, but for them also to be non-flammable. The textile substrate is therefore preferably separately flameproofed before it is coated.

The textile or other sheet material substrate is coated with a mixture which assumes the form of a thin film, for example, a film of the order of 40 to 200$\mu$ thickness.

The photoluminescent textile and other sheet materials of the present invention are remarkable in that they comprise a textile or other sheet material substrate to which a coating layer adheres, the said coating layer comprising one or more synthetic resins admixed with the ingredients of a photoluminescent complex, the latter being formed, on the one hand, from a phosphorescent metal sulphide such as zinc sulphide, and on the other hand from a first substance which absorbs energy of short wave-length and emits it with the absorption spectrum of the said phosphorescent sulphide, and with or without a second substance which is of the fluorescent kind and which imparts to the said sheet materials a daytime coloration which is different from their nighttime coloration.

There may additionally be provided between the said flexible substrate and the said coating layer a bonding layer comprising one or more synthetic resins admixed with a photoluminescent complex.

The present invention involves the selection of resins which can be used and which are compatible with the various textile substrates as well as the use to which it is desired to put the substrate in the fields of clothing and/or furnishing fabrics.

It has been found that four groups of resins are entirely satisfactory for this purpose and meet the requirements stated above.

These are:

(1) Polyurethane resins: these are used for protective garments and for garments for children and for the police; outer garments and overgarments for labourers working on the roads and overgarments for labourers who work out of doors during all or a part of the night. These overgarments or capes must have the following characteristics:

(a) they must be sufficiently strong in the lengthwise or warp direction of the fabric, having a dynamometric strength greater than 45 kg.

(b) they must have adequate tear resistance (more than 3.2 kg in both the warp and weft directions) as measured by the Elmendorf method;

(c) the coated fabrics or garments need to remain supple under frosty conditions and the shower proofing or waterproofing effect imparted thereto should be adequate to prevent water from penetrating during a fairly heavy shower. The coated film should remain flexible for several months and should not become detached from the textile substrate; it therefore needs to be resistant to hydrolysis. Permeability by water vapour is preferably very high, i.e. more than 400 gr per $m^2$ per day, so that the garment coated by doctor blade or the polyurethene coated garment is comfortable to wear.

(2) Resins based upon polyvinyl chloride; these may also be used but the resulting garments will chiefly be used for protection against extreme weather conditions because the comfort of the wearer is considerably less than with polyurethane base resins. Conversely, for resistance to sea water or large amounts of water, garments made from photoluminescent textile materials comprising polyvinyl chloride are used for preference.

Another product is a self-adhesive material which generally has a basis of a polyvinyl chloride resin.

(3) Resins formed from polyacrylates and/or acrylates. These resins are chiefly used in the form of a foam which is produced by injecting air in the course of producing the mixture, which mixture also contains the photoluminescent complex. When a coating material of this kind is prepared, possible applications are not only garments but also furnishing materials, that is to say, curtaining, wall coverings and chair coverings.

(4) Resins which consist principally of elastomeric silicones, which may also be used to obtain very supple garments.

It is of course possible to mix together a number of the above mentioned resins whilst remaining within the scope of the present invention.

The invention also relates to the photoluminescent complex which is mixed with the resin or resins to obtain the coating layer.

This photoluminescent complex always contains one or more phosphorescent metal sulphides such as zinc sulphide or calcium sulphide. Moreover, the complex will always contain a first substance which absorbs energy of short wave-length and emits it at wavelengths which lie within the absorption spectrum of the phosphorescent constituent or constituents of the complex.

By way of example, this first substance may be an aromatic compound such as an aromatic hydrocarbon or preferably a substance such as PPO (diphenyloxazole). This substance is present in a very small proportion relative to both the phosphorescent constituent or constituents and to the resin used. On the average, this first substance will be present in the mixture in the approximate proportion of $10^{-3}$ mole per kilo of resin. In addition to PPO use may also be made of 2,5-diphenylfurane, para-phenylene-2,2'-bis(phenyl-5-oxazole) or its dimethyl derivative, and di-(3-ethylheptyl)-para-quinquephenyl. A mixture of such aromatic compounds may also be used as the first substance.

A second substance is preferably also included in the photoluminescent complex. What is essentially required are fluorescent substances having an emission spectrum located towards the longer wave-lengths within or outside the absorption/emission spectrum of the phosphorescent material or materials. The function of this second substance is to give the article a daytime coloration different from its nighttime coloration. For example, use may be made of rhodamine B, fluorescein or uranine S, even though these two latter substances have an emission spectrum close to that of zinc sulphide. The second substance will in any case be incorporated in the mixture in a proportion of substantially $10^{-4}$ to $10^{-6}$ mole per kilo of resin.

It is preferred that the photoluminescent complex comprise PPO, zinc sulphide and a fluorescent substance which emits light at wave-lengths of from 5500 to 7500 Å.

It is important to mention that the photoluminescent complex is not only responsible for the photoluminescence of the sheet material. Surprisingly, the complex also modifies certain properties of a textile substrate itself and in particular its permeability by water vapour. It has in fact been shown, that when the resin is a polyurethane resin, garments made from the resulting textiles (substrate plus resin with photoluminescent complex) have a permeability to water vapour appreciably higher than that obtained in the absence of the photoluminescent complex. The result is of course an increased feeling of comfort for the wearer of garments made therefrom.

DESCRIPTION OF THE PREFERRED EMBODIMENTS

Some examples will now be given. In these examples, the ingredients of the photoluminescent complex comprise zinc sulphide with PPO as the first substance; there is no second substance in these examples.

EXAMPLE I

A foam is produced from the following ingredients:
100 parts of acrylate resin as a dispersion.
40 parts of zinc sulphide plus 0.02 parts of PPO.
1 part of sodium lauryl sulphate.
8 parts of foam stabiliser.
40 parts of calcium sulphate.
10 parts of dimethylol dihydroxyethyleneurea.

The dispersion, the calcium sulphate, the foam stabiliser, the photoluminescent complex and the sodium lauryl sulphate are placed in a vat in that order. The whole is mixed for 30 minutes and the mixture is fed to the apparatus which produces the foam. In this apparatus air is also fed in to form a mixture and a very dense foam having a density of 180 gr per liter is obtained.

This foam is then coated directly, by means of a doctor blade, onto a fabric, which in the present example is 100% cotton although there are other applications to linen and synthetic fibers which are possible. However in this example the fabric is cotton and to it is applied a coating weight of 200 gm of dry product per $m^2$. After drying at 110° C. the coated fabric is calendered between two rollers, one roller having a surface of bare metal and the other being coated with paper, at a pressure of 9 kg per linear meter. Heat is then applied at 160° C. for 3 minutes and the finished product is obtained. A textile material of this kind is mainly used for wallcoverings, curtaining or chair coverings.

In this example, the coating layer is applied directly to the textile. This is not the case in the following examples, where a bonding layer is interposed, by coating, between the textile or other flexible sheet material substrate and the coating layer proper. The coating layer proper and the bonding layer comprise a mixture of resin and photoluminescent complex, in which case the kind of resin and/or the nature of the photoluminescent complex may be different in the coating layer and the bonding layer.

EXAMPLE II

Coating from a solvent, using a solvent medium.

This is coating by transfer, where a layer of approximately 30 gr per $m^2$ is applied to a siliconised paper by means of a doctor blade, this layer containing,
100 parts of an acrylate resin in a solvent therefor,
40 parts of zinc sulphide plus 0.02 parts of PPO,
2.5 parts of catalyst.

This material is prepared as follows: In a vat, a solution of the acrylate resin is formed by stirring and then the zinc sulphide and PPO and the catalyst are added in that order and the mixture is stirred for 20 minutes. After coating (i.e. by means of the doctor blade), drying is effected at 120° C. and the whole is then cooled. Thereupon a second layer is coated, which is the bonding layer and which contains:
100 parts of acrylate resin as a dispersion,
5 parts of dimethylol dihydroxyethyleneurea,
40 parts of zinc sulphide plus 0.02 parts of PPO,
3 parts of thickener.

The preparation of this second coating material is carried out as follows:

The dispersion of acrylate resin is placed in a vat whilst stirring and then the dimethylol dihydroxyethyleneurea, the ingredients of the photoluminescent complex and finally the thickener are added thereto. Mixing is carried out for 35 minutes and the second layer is then coated, also by means of a doctor blade. A coating weight of approximately 25 gr per $m^2$ is required. Directly after the application of this second layer, the textile substrate is pressed into contact with the bonding layer. Drying and curing take place at 160° C.; the product is then cooled and after cooling the siliconised paper substrate is removed; the fabric, coated with its two layers, is then rolled up without the siliconised paper.

EXAMPLE III

Coating with a nonflammable polyurethane.

The textile substrate which is to be used as substrate may be a woven or knitted polyamide, and it will first have been rendered non-flammable by treatment with a fireproofing product such as a halogenated organic complex containing phosphorus. Knitted or woven polyester may also be used after it has, of course, been rendered fireproof using an organic product containing phophorus. Use may also be made of cellulose fibres which have been rendered flameproof with an inorganic flame retardant or substance based upon organic phosphorus. The layers are applied in succession, the first to a siliconised paper at a coating weight of approximately 90 gr per $m^2$. Drying then takes place at 100° C. After cooling, a second, bonding layer is applied at a coating weight of approximately 100 gr per $m^2$. Directly afterwards, the textile substrate is applied to the surface of the second layer. Curing is effected at 160° C. and after cooling the siliconised paper is removed: thus the coated fabric and the siliconised paper are separated. The formulations used are as follows:

first layer:
100 parts of polyurethane resin,
40 parts of zinc sulphide plus 0.02 parts of PPO,
12 parts of fireproofing substance,
10 parts of dimethylformamide.

second layer:
100 parts of organic polyisocyanate,
40 parts of zinc sulphide plus 0.02 parts of PPO,
7 parts of a polyol,
5 parts of catalyst,
12 parts of fireproofing substance.

EXAMPLE IV

Coating a polyamide fabric with polyvinyl chloride.
25 parts of polyvinyl chloride.
17 parts of dioctyl phthalate (plasticiser),
0.7 parts of stabiliser (for the PVC),
20 parts of zinc sulphide plus 0.01 parts of PPO,
3 parts of isocyanate components.

For the second, bonding layer are used:
25 parts of polyvinyl chloride,
17 parts of dioctyl phthalate,
0.7 parts of coloured pigment,
20 parts of zinc sulphide plus 0.01 parts of PPO.

These two layers are successively applied to a polyamide fabric by means of a doctor blade, the first layer at a coating weight of 120 gr per $m^2$. This layer is dried and pregelled at 120° C. and then the second layer is applied, at a coating weight of 310 gr per $m^2$. Drying and gelling take place at 170° C. While the fabric is still warm and is in the plastic state the fabric is calendered between a pair of rollers, one roller having a bare metal surface and the other is covered with paper.

EXAMPLE V

Coating with a mixture of product: a layer which contains the undermentioned ingredients is applied to a siliconized paper.

50 parts of an elastomeric silicone,
2 parts of catalyst,
50 parts of polyacrylate resin,
1 part of catalyst for the polyacrylate resin, 1.5 parts of n-butanol,
30 parts of zinc sulphide plus 0.02 parts of PPO.

This composition is applied by means of a doctor blade at a coating weight of 75 gr per $m^2$.

Drying takes place at 120° C. and is followed by cooling. To this first layer a second bonding layer is applied at a coating weight of 110 gr per $m^2$ by means of a doctor blade. The composition of this second layer is as follows:

100 parts of polyisocyanate,
5 parts of polyol combination,
5 parts of catalyst,
40 parts of zinc sulphide plus 0.02 parts of PPO,
10 parts of dimethylformamide.

Directly after the application of the second layer, the textile material is applied. The textile is brought into contact with the upper layer and thereafter drying and gelling is effected at 170° C. After cooling, the siliconized paper is removed in the usual way and the textile with its two coating layers is rolled up separately from the paper.

EXAMPLE VI

Self-adhesive articles:

To a special paper(substrate) is applied a first layer at a coating weight of approximately 175 gr per $m^2$. Drying is effected at 120° C. and after cooling a second layer is applied at a coating weight of 190 gr per $m^2$. Drying and gelling is carried out 170° C. All parts are by weight.

The composition of the first layer is:
30 parts of polyvinyl chloride,
29 parts of plasticiser for the PVC,
2 parts of stabiliser for the PVC,
30 parts of zinc sulphide plus 0.01 parts of PPO.

The composition of the second layer is:
36 parts of polyvinyl chloride,
29 parts of plasticiser for the PVC,
2 parts of stabiliser for the PVC,
40 parts of zinc sulphide plus 0.01 parts of PPO.

After cooling a third layer is applied at a coating weight of 60 gr per $m^2$, the layer comprising:
100 parts of acrylate resin,
4 parts of thickener,
10 parts of white pigment e.g. titania.

Drying is effected at 120° C. and is followed by cooling. After cooling, a protective paper is applied to the surface of the third layer, which constitutes the adhesive.

The first paper (substrate) is then removed. The protective paper and the adhering three layers are then rolled up separately.

In this example, the first applied layer replaces the textile substrate; and the same may be said of the second layer which is virtually identical with the first layer. The layers so obtained may very easily be cut into small pieces and their self-adhesive properties enable them to be applied to clothing or to any clothes or other objects which need to be easily discernable during the night.

EXAMPLE VII

Printing on a coated substrate;

To a substrate obtained by one of the procedures described in the preceding examples is applied an organic pigment by means of a half tone printing cylinder, to obtain a multicoloured article which shows different colours by daylight.

In this way, a layer having a coating weight of approximately 5 gr per $m^2$ is applied to the surface, the layer containing:

100 parts of binder,
10 parts of dimethylformamide,
25 parts of an organic pigment, Drying is effected at 130° C.

The printing will produce a colour upon a photoluminescent background or a photoluminescent colour upon a photoluminescent colour background as the case may be.

It should be noted that the direct overprinting of a thin layer of coloured pigment upon a photoluminescent coating layer makes it possible to alter the daytime colouring without reducing the photoluminescent effect to an excessive degree.

Other colour effects are possible depending upon the overlay colour selected and/or the intensity of this colour. Thus, zinc sulphide may be used alone or in admixture with other sulphides the emission spectrum of which corresponds with the absorption spectrum of zinc sulphide, such as calcium sulphide which emits in the blue part of the spectrum. The result is then a cascade effect, which means increased photoluminescence of the zinc sulphide.

We claim:

1. A photoluminescent flexible sheet material having an enhanced premability to water vapor comprising:

a flexible substrate of sheet material having at least one coating film adhering to a surface of said substrate;

said film comprising at least one synthetic resin compatible with said flexible substrate and having dispersed therethrough a photoluminescent complex having enhanced stability to ultraviolet energy and atmospheric moisture;

said photoluminescent complex comprising particles of at least one phosphorescent metal sulphide and an organic substance which absorbs radiant energy of short wavelengths and emits the energy on a wavelength lying within the absorption spectrum of said phosphorescent metal sulphide.

2. The photoluminescent sheet material of claim 1 wherein said film of synthetic resin additionally has dispersed therethrough (c) a fluorescent material whereby said material exhibits a different colour by daylight than that exhibited by nightlight.

3. The photoluminescent sheet material of claim 1 in which said flexible substrate is a textile material substrate and said synthetic resin is selected from the group consisting of polyurethane resins, polyvinyl chloride base resins, polyacrylate resins and elastomeric silicone resins.

4. A photoluminescent flexible sheet material comprising a flexible substrate of sheet material having at least one coating film adhering to a surface of said substrate;

said film comprising at least one synthetic resin compatible with said flexible substrate and having dispersed therethrough a photoluminescent complex having enhanced stability to ultraviolet energy and atmospheric moisture;

said photoluminescent complex comprising particles of at least one phosphorescent metal sulphide and an organic substance which absorbs radiant energy of short wavelengths and emits the energy on a wavelength lying within the absorption spectrum of said phosphorescent metal sulphide, and said substance is selected from the group consisting of 2,5-diphenyloxazole, 2,5-diphenylfurane, para-phenylene-2,2'-bis(phenyl-5-oxazole), dimethyl paraphenylene-2,2'-bis(phenyl-5oxazole) and bis-(3-ethylheptyl)para-quinquephenyl.

5. The photoluminescent sheet material of claim 1 in which said substance is present in a concentration of substantially $10^{-3}$ mole per kilogram of said synthetic resin.

6. The photoluminescent sheet material of claim 2 in which said substance (c) is present in a concentration of from $10^{-4}$ to $10^{-6}$ mole per kilogram of said synthetic resin.

7. The photoluminescent sheet material of claim 2 in which said fluorescent material is selected from the group consisting of rhodamime B, fluorescein and uranine S.

8. The photoluminescent sheet material of claim 1 in which said flexible substrate is a textile material of the non-flammable kind.

9. The photoluminescent sheet material of claim 1 wherein the coating film has a thickness of 40 to 200$\mu$.

10. The photoluminescent sheet material of claim 1 wherein the exposed surface of the synthetic resin-containing film has been overprinted in selected areas with a pigmented composition.

11. The photoluminescent sheet material of claim 10 wherein the pigment of said pigmented composition is a photoluminescent pigment.

12. A method of producing a photoluminescent flexible sheet material having an enhanced permeability to water vapor which comprises applying to a flexible substrate of sheet material a coating of a composition comprising at least one synthetic resin compatible with said substrate, said composition having dispersed therethrough (a) particles of at least one phosphorescent metal sulphide and (b) an organic substance which absorbs radiant energy of short wavelengths and emits the energy on a wavelength lying within the absorption spectrum of said phosphorescent metal sulphide said particles (a) and said substance (b) forming a photoluminescent complex having enhanced stability to ultraviolet energy and atmospheric moisture.

13. The method of claim 12 in which said synthetic resin additionally has dispersed therethrough (c) a fluorescent material.

14. The method of claim 12 in which said flexible substrate is a textile material substrate and said compatible synthetic resin is selected from the group consisting of polyurethane resins, polyvinyl chloride base resins, polyacrylate resins and elastomeric silicone resins.

15. The method of claim 12 in which in said composition said substance (b) is present in a concentration of substantially $10^{-3}$ mole per kilogram of said synthetic resin.

16. The method of claim 13 in which said composition said substance (c) is present in a concentration of from $10^{-4}$ to $10^{-6}$ mole per kilogram of said synthetic resin.

* * * * *